United States Patent [19]

Green

[11] Patent Number: 5,017,032

[45] Date of Patent: May 21, 1991

[54] PRINTER ENCLOSURE

[76] Inventor: Dennis L. Green, 17821 SW. Tamara Ave., Lake Oswego, Oreg. 97035

[21] Appl. No.: 501,779

[22] Filed: Mar. 30, 1990

[51] Int. Cl.[5] ..... B41J 29/02

[52] U.S. Cl. ..... 400/693; 400/691; 312/208

[58] Field of Search ..... 400/691, 692, 693; 312/208, 196; 211/45, 50; 181/200, 201

[56] References Cited

U.S. PATENT DOCUMENTS

| | | | |
|---|---|---|---|
| 3,930,559 | 1/1976 | Frick | 181/33 K |
| 4,252,453 | 2/1981 | Estabrooks | 400/690.1 |
| 4,526,489 | 7/1985 | Tsumuraya et al. | 400/693 |
| 4,550,798 | 11/1985 | Swartz et al. | 181/201 |
| 4,696,522 | 9/1987 | Lowe | 312/208 |
| 4,726,699 | 2/1988 | Buschmann et al. | 400/690 |
| 4,729,452 | 3/1988 | Sims | 181/201 |
| 4,755,010 | 7/1988 | Wilson et al. | 400/691 |

*Primary Examiner*—Edgar S. Burr
*Assistant Examiner*—Ren Yan
*Attorney, Agent, or Firm*—Kolisch, Hartwell, Dickinson, McCormack & Heuser

[57] ABSTRACT

A printer enclosure for a paper-outputting printer that has back and bottom boundaries is disclosed. The enclosure includes an enclosure body defining a printer cavity and includes a bottom face with a gravity-outputting slot formed therein. The enclosure also includes means extending from the body into the cavity for supporting the printer in the cavity and orienting the printer therein so that gravity will cause paper outputted from the printer to be directed downwardly to the slot.

7 Claims, 2 Drawing Sheets

PRINTER ENCLOSURE

BACKGROUND OF THE INVENTION

The present invention relates to enclosures, and more particularly to enclosures for computer printers.

The tremendous advances in computer technology together with ever-increasing numbers of individuals and businesses using computers have resulted in a corresponding increase in the demand for so-called peripherals such as computer printers. Further, with the increase in demand for computer printers has come an awareness of the need to develop appropriate enclosures for printers.

Until now, computer printer enclosure technology has focused on the need to provide enclosures that absorb sound/noise produced by the printer when it prints. Various solutions have been proposed such as the printer cabinets shown in U.S. Pat. Nos. 4,729,452 to Sims; 4,526,489 to Tsumuraya et al.; and 3,930,559 to Frick. Sims and Frick are representative of one sound-deadening approach which involves the provision of a foam lining inside the printer cabinet. Tsumuraya et al. shows another approach in which projections are provided adjacent and outside a paper-exit slot to substantially reduce sound that escapes through the slot.

Totally missing from conventional printer cabinets are proposals that deal with the problem of paper-output jams. Specifically, this problem can occur when paper, in the usual form of sheets removably attached end-to-end, is fed into and outputted from printers housed in conventional printer cabinets. Known printer cabinets are susceptible to such paper-outputting jams because they include outputting means that do not allow gravity to substantially control outputting.

Examples of such printer cabinets are shown in Sims and Tsumuraya et al. In the printer cabinets disclosed in these patents, paper is outputted from a printer in a horizontal direction and fed, while inside the cabinet, to a paper-feed slot. The slot is aligned with the printer so that paper outputted horizontally therefrom will feed into the slot. Thus, the portion of paper located between the printer and the slot is suspended therebetween. It is not until the paper passes outward of such slot that the paper is allowed to fall to the floor under gravity.

In a printer cabinet with the above design, portions of the paper outputted from a printer housed therein may move out of alignment with the paper-feed slot before reaching the same. For example, the paper suspended between the slot and printer may sag. As a result, the rate at which paper is outputted from the cabinet is slowed because the paper will bunch up inside the cabinet adjacent the paper-feed slot. If this condition goes unnoticed, the paper will eventually be prevented from exiting the printer altogether.

Alternatively, if the cabinet is positioned so that other objects are behind it and adjacent the paper-feed slot, the paper may bunch up outside the printer cabinet instead of falling to the floor under gravity.

The problem is exacerbated when there are irregularities, such as folds/creases, in the paper. These irregularities, coupled with the above-described paper-output and paper-feed slot design, make it even more likely that paperoutput jams will occur.

In either of the above situations, paper will not feed out of the cabinet as desired, and will not perform the selfstacking capability that it is designed to have in ideal, nonpaper-outputting-jam situations such as that shown in FIG. 2 of Tsumuraya et al.

It is therefore an object of the present invention to provide a printer enclosure that prevents such paper-outputting jams.

Another object of the present invention is to provide a printer enclosure that is usable to enclose a printer in a place other than the space on a desk or shelf, so that such space is available for storage of other office articles.

SUMMARY OF THE INVENTION

The present invention achieves the above objects by providing a printer enclosure for a paper-outputting printer that includes an enclosure body defining a printer cavity. The body includes a bottom face with a gravity-outputting slot formed therein. Also, there is means extending from the body into the cavity for supporting the printer in the cavity and orienting the printer therein so that gravity will cause paper outputted from the printer to be directed downwardly to the slot.

These and additional objects and advantages of the present invention will be more readily understood after considering the drawings and the detailed description of the preferred embodiment.

DETAILED DESCRIPTION OF THE PREFERRED EMBODIMENT

Figure 1:
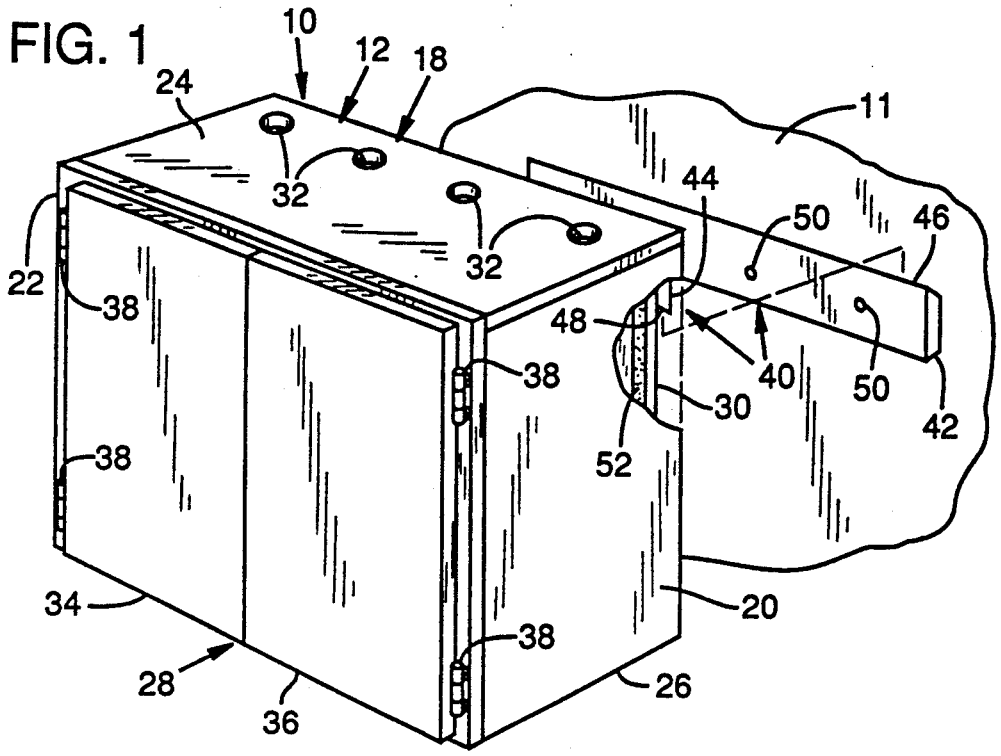
FIG. 1 is a perspective, partially exploded view of a preferred embodiment of the present invention in a closed condition with a portion of it broken away to show detail.
Figure 2:
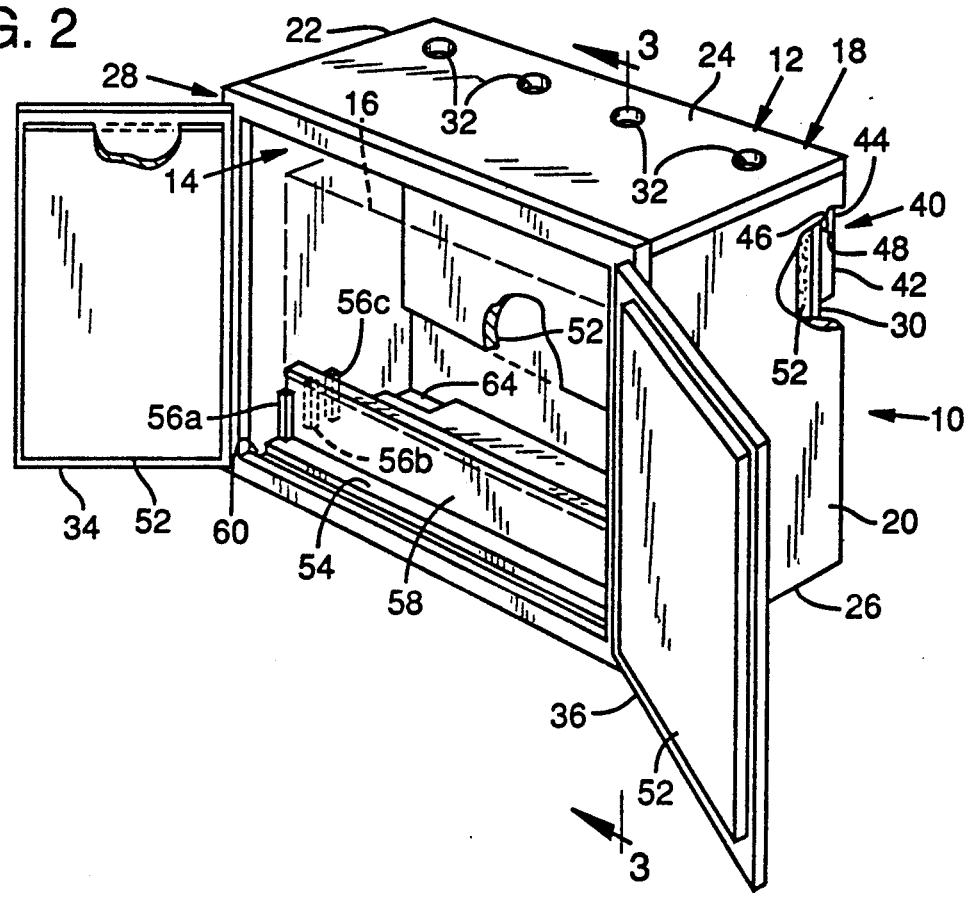
FIG. 2 is like FIG. 1 except that the present invention is shown in an open condition and additional portions are broken away to show detail.

Referring to FIGS. 1–2 the preferred embodiment of the present invention is shown at 10. Printer enclosure 10 includes an enclosure body 12 defining a printer cavity 14 to be filled by a printer 16, shown by dotted lines in FIG. 2.

Preferably, body 12 is shaped as a parallelepiped 18 that includes side faces 20, 22, top and bottom faces 24, 26, respectively, and front and back faces 28, 30, respectively. I have found that the following inside dimensions for body 12 are suitable for personal computer printers:

(1) width=approximately twenty-one inches (for relatively wide printers, twenty-eight inches is necessary);

(2) height=approximately nineteen inches; and (3) depth=approximately nine inches.

Body 12 may be made of any suitable material such as wood or plastic.

Continuing with the description of FIGS. 1–2, top face 24 has a plurality of circular-shaped heat-relief vents 32 formed in it. Preferably, vents 32 are about one-half inch in diameter. Front face 28 includes dual doors 34, 36 attached to the front face by hinges 38. Alternatively, front face 28 may include a single door (undepicted). Also, the inside surface of the door(s) and the outside surface of front face 28 that borders the door(s) may include appropriately positioned magnetic latches (undepicted) to releasably hold the door(s) in a closed condition.

Figure 3:
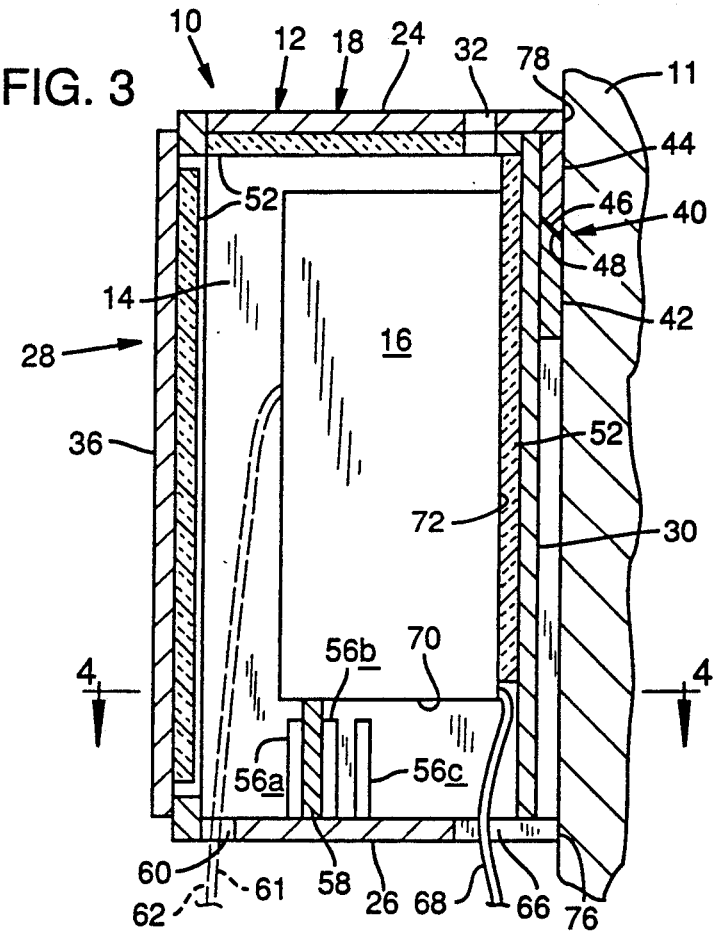
FIG. 3 is a side-sectional view through line 3-3 of FIG. 2.

Referring to FIGS. 2 and 3, enclosure body 12 is attachable to wall 11 by wall fastener 40. Wall fastener 40 includes two generally rectangularly shaped wall-fastener members 42, 44, each of which include complementary, angular edges 46, 48, respectively.

Wall-fastener member 42 is attachable to wall 11 by a plurality of screws 50, two of which are shown in FIG. 1. Likewise, wall-fastener member 44 is attachable to back face 30 by screws (undepicted).

Viewing FIGS. 1-3, a foam lining 52 is positioned adjacent printer cavity 14 and attached as by adhesive to inside surfaces of front and back faces 28, 30, respectively. The lining may also be attached (undepicted) to the inside surfaces of side faces 20, 22. Lining 52 reduces the noise associated with printer 16 when it is in a print mode (undepicted) by absorbing the sound produced by such printing. The lining may be made of a suitable synthetic foam such as one-half-inch polyurethane foam that can withstand a pressure of one hundred pounds per square inch.

Figure 4:
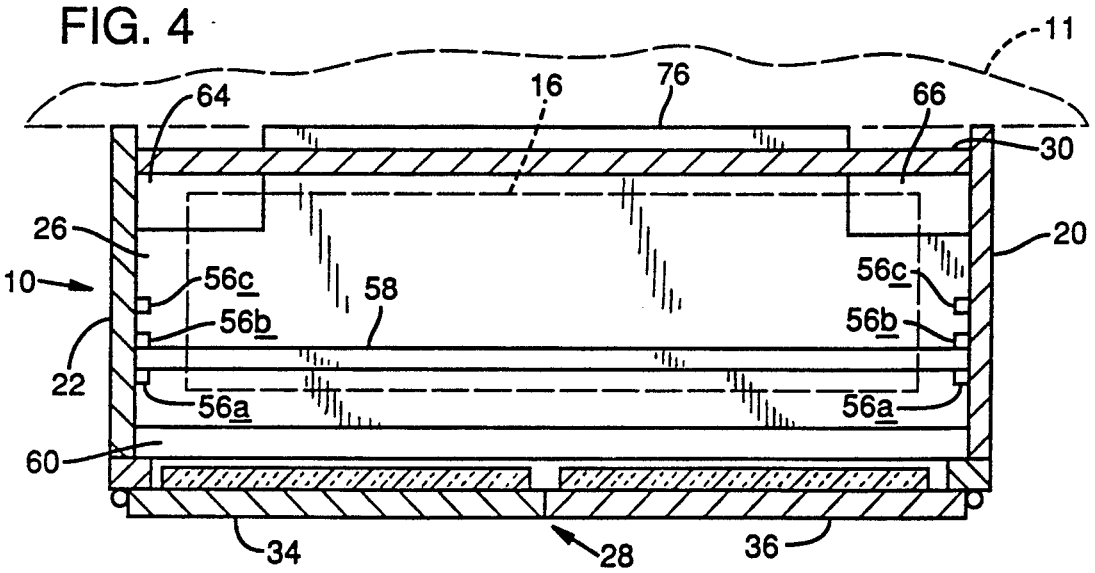
FIG. 4 is a transverse sectional view through line 4-4 of FIG. 3 that has been rotated 90 degrees counterclockwise.

Turning now to FIGS. 2-4, the aforementioned supporting and orienting means will be discussed in detail. Outwardly extending from opposite ends of an inside surface 54 of bottom face 28 are a plurality of rectangular posts **56*a*, 56*b*, 56*c*. In the preferred embodiment, a total of six posts are provided, with three posts being positioned adjacent one edge of inside surface 54 and the other three being positioned directly opposite thereto adjacent the opposite edge of inside surface 54 (FIG. 4). The posts can be attached to inside surface 54 by any suitable means such as by adhesive or screws. If, as mentioned above, lining 52 is attached (undepicted) to inside surfaces of side faces 20, 22, then posts 56*a*, 56*b* and 56*c*** must be positioned adjacent the inner surface of such lining.

Still referring to FIGS. 2-4, posts **56*a*, 56*b*, 56*c* define two alternate tracks for positioning supporting and orienting means 58 therein. Means 58 may take the form of a riser. As shown in FIGS. 2-4, riser 58 is positioned in a track that is outermost relative to back face 30 and is formed by posts 56*a*, 56*b*. However, while not shown, riser 58 could be placed in the track formed by posts 56*b*, 56*c*. Preferably, riser 58 is a threeinch by twenty-inch riser of suitable length to span the distance between side faces 20, 22. If the side faces have foam lining on their inside surfaces (undepicted), then the riser should be of suitable length to span the distance between the inner surfaces of such lining. 14. Those skilled in the art know that printer 16 includes a paper-exit port (undepicted) through which paper is outputted. Formed in enclosure 10 is a gravity-dispensing slot, or aperture 60 for outputting paper 62 that is fed from printer 16 out of enclosure 10. As best shown in FIG. 3, riser 58 supports and orients printer 16 in cavity 14 so that gravity will cause paper outputted from the printer to be directed downwardly to slot 60**.

Also formed in bottom face 26 are printer-cable-access voids 64, 66 for allowing printer cable 68 (FIG. 3) to be accessed from outside enclosure 10. As used herein, "printer cable" means any type of cable which exits from the printer, such as cables for connection to an electrical power source or cables for connection to a computer.

OPERATION

To mount printer enclosure 10 on wall 11, wall-fastener member 42 is attached to the wall by screws 50. Then, after raising the enclosure so that wall-fastener member 44 is above member 42, the enclosure is slid adjacent and down the wall to a position where angular edges 46, 48, of members 42, 44, respectively, engage each other. Thus, the enclosure is held in a vertical position relative to wall 11 with a back edge 76 of bottom face 26 and a back edge 78 of top face 24 contacting the wall.

Printer 16 is placed in printer cavity 14 by opening doors 34, 36 and positioning printer 16 vertically in printer cavity 14 so that a back boundary 70 of the printer rests against a top surface of riser 58. To support the printer in a vertical orientation, the riser needs to be positioned on inside surface 54 to contact back boundary 70 at a location that will cause a bottom boundary 72 of the printer to press against the foam lining attached to back face 30. Thus, depending on the length of back portion 70 (i.e. the height of printer 16), the required location of riser on inside surface 54 will vary.

Presently, I have noted that computer printers have heights that fall in one of two classes. A first class of printers has a height of approximately four and one half to five inches. That is, if printer 16 were in this first class, its height, i.e. the length of back boundary 70 (FIG. 3) would be approximately four and one-half to five inches.

In such a case, to allow for the one-half inch thickness of lining 52, a track should be formed on inside surface 54 by corresponding pairs of posts **56*a*, 56*b* so that the center of riser 58 is approximately five inches from the inside surface of back face 30. The result will be that riser 58 will contact back boundary 70 in a location that causes bottom boundary 72 to press against the foam lining attached to back face 30. Referring to FIG. 3, such a position for riser 58 is obtained by placing it in the outermost track, relative to back face 30, formed by posts 56*a*, 56*b***.

A second class of printers is three and one-half to four inches high. In this case, riser 58 should be positioned in a track on inside surface 54 so that its center is approximately four inches from the inside surface of back face 30 (again allowing for the one-half inch thick lining 52). Referring to FIG. 3, such a track is shown as that innermost relative to back face 30, and formed by posts **56*b*, 56*c***.

By supporting and orienting printer 16 as shown in FIGS. 2-4 the present invention provides for gravity-outputting of paper from cavity 14, through slot 60, and out of enclosure 10. Surprisingly, using an enclosure like enclosure 10, there are substantially fewer paper-outputting jams when paper is fed into printer 16 as shown at 61, and then outputted from the printer as shown at 62.

Those skilled in the art will also appreciate that printer 16 is well supported within enclosure 10 and can be easily placed into, or removed from, the enclosure. There is no need for fasteners to hold the printer in place which reduces installation or removal time.

Additionally, once printer 16 is in place, printer cable 68 can be accessed from the enclosure via printer-cableaccess void 64 to be connected to a suitable electrical outlet (undepicted).

Once wall-fastener member 42 is attached to wall 11, the printer enclosure is easily taken off of the wall without having to deal with screwdrivers, or other fastener-type tools. To take enclosure 10 off of wall 11, one need only lift the enclosure slightly up the wall to disengage angular edges 46, 48 from each other.

Those skilled in the art will appreciate that providing supporting and orienting means 58 results in a natural tensing of outputted paper due to gravity which substantially reduces the problem of paper-outputted jams.

While the present invention has been shown and described with reference to the foregoing preferred embodiment, it will be apparent to those skilled in the art that other changes in form and detail may be made therein without departing from the spirit and scope of the invention as defined in the appended claims.

It is claimed and desired to secure by letters patent:

1. A printer enclosure for a paper-outputting printer that has a paper-exit port and back and bottom boundaries, the printer enclosure comprising:

an enclosure body defining a printer cavity and including a bottom face with a gravity-outputting slot formed therein; and means extending from the body into the cavity for supporting the printer in the cavity and orienting the printer therein so that gravity will cause paper outputted from the printer to be directed downwardly to the slot.

2. The enclosure of claim 1 wherein the supporting and orienting means is at least one riser that upwardly extends from the bottom face.

3. The enclosure of claim 2 wherein the body further includes a back face and the supporting and orienting means is positioned to hold the printer in the cavity in a vertical position with the back boundary adjacent the bottom face and the bottom boundary adjacent the back face.

4. The enclosure of claim 3 wherein the riser further includes a top surface and the back boundary contacts the top surface.

5. The enclosure of claim 4 further including a wall fastener for removably fastening the body to a wall.

6. The enclosure of claim 5 wherein the wall fastener includes first and second wall-fastening members with corresponding and complementary angular edges that engage each other to removably fasten the enclosure to the wall.

7. The enclosure of claim 6 wherein the first wallfastening member is coupled to the wall and the second wallfastening member is coupled to the back face of the enclosure body.

* * * * *